US006898903B1

(12) United States Patent
Thomas

(10) Patent No.: US 6,898,903 B1
(45) Date of Patent: May 31, 2005

(54) KIT FOR FORMING AN ARCH OR ARCH SECTION

(76) Inventor: John S. Thomas, 612 W. Hargett St., Raleigh, NC (US) 27603

( * ) Notice: Subject to any disclaimer, the term of this patent is extended or adjusted under 35 U.S.C. 154(b) by 53 days.

(21) Appl. No.: 10/449,241

(22) Filed: May 30, 2003

(51) Int. Cl.[7] ..... E04B 1/32; E06B 1/00
(52) U.S. Cl. ..... 52/86; 52/88; 52/204.1
(58) Field of Search ..... 52/86, 88, 211, 52/213, 204.1; D25/60

(56) References Cited

U.S. PATENT DOCUMENTS 4,301,632 A * 11/1981 Wagner ..... 52/211
4,400,917 A * 8/1983 Massaro et al. ..... 52/86
4,601,138 A * 7/1986 Hampton ..... 52/86
4,665,666 A * 5/1987 Hampton ..... 52/86
5,291,717 A * 3/1994 Turner ..... 52/745.07
5,526,618 A 6/1996 Thomas
5,572,834 A * 11/1996 Lilly ..... 52/85
5,588,265 A * 12/1996 Gill ..... 52/167.1
5,688,351 A 11/1997 Thomas
6,401,405 B1 * 6/2002 Hicks ..... 52/88

* cited by examiner

*Primary Examiner*—Brian E. Glessner
(74) *Attorney, Agent, or Firm*—Coats & Bennett, P.L.L.C.

(57) ABSTRACT

A kit includes a series of components, capable of being flat packed, that can be assembled to form an arch or a section of an arch for use in a building such as a residential structure. The kit includes a pair of curved sides with each curved side including an inner face, an outer face, an upper edge and a lower edge. Formed along the inner face of each side is a curved groove. A flexible or pliable jamb is provided in the kit. Secured in spaced apart relationship along one side of the jamb is a series of clips. When assembled, the arch or arch section includes the clips extending between these sides and including portions that project into the curved grooves. The clips effectively secures the jamb to the sides.

29 Claims, 4 Drawing Sheets

KIT FOR FORMING AN ARCH OR ARCH SECTION

FIELD OF THE INVENTION

The present invention relates to building structures, and more particularly to a kit for forming arches within a structure.

BACKGROUND OF THE INVENTION

For many years, architects, home designers, contractors and consumers have not incorporated arched openings in structures, particularly residential homes. The aversion to arched openings has nothing to do with appeal or the demand for such. For so long, the cost factor has precluded arches from being routinely used in residential construction, especially homes in the lower to moderate price range. The basic problem giving rise to cost considerations is that in the past such arch structures have, for the most part, been constructed on site by highly skilled trim carpenters. Custom making arched openings, even when done by skilled and experienced craftsmen, is time consuming, tedious, and in the end, very expensive.

In recent years, architects, home designers and building contractors have had available to them prefabricated arch structures. For example, see U.S. Pat. No. 5,526,618, the disclosure of which is expressly incorporated herein by reference. In this patent, there is shown a prefabricated arch where the major components, including an arched header and a pair of columns, are prefabricated for installation into an opening within the structure. Such prefabricated arches have met with substantial commercial success. They can be manufactured in various sizes and with various moldings and trim. While these prefabricated arches have generally been successful in the marketplace, they still are not used on a routine basis in residential structures. There may be a variety of reasons for this, including the cost of such prefabricated arch structures. In addition, many such prefabricated arch structures are still custom made off site and shipped to a distributor or contractor for use in a particular building. Such structures are difficult and expensive to ship, not to mention the problems that often arise because of damage sustained in shipment.

Therefore, there continues to be a need for an arch structure that can be used in a wide variety of applications and which can be sold at a price point that will make arch structures suitable for homes within a wide price range.

SUMMARY OF THE INVENTION

The present invention entails a kit for forming or assembling an arch where the components are packaged and delivered to a wholesale or retail outlet where consumers, builders and contractors purchase the kits and thereafter install them in existing homes as well as new homes and other structures.

The kit of the present invention includes a pair of curved sides with each side including a curved groove formed in the same. A jamb is provided and is adapted to assume a curve configuration. A series of clips is also provided with each clip secured to the jamb and extending therefrom. When the arch or arch section is assembled, the clips include portions that project into the curved groove formed in each side. Thus, the clips effectively secure the jamb to the curved sides.

The present invention also entails a method of forming an arch or an arch section for use in a building such as a residential structure. This method includes securing a flexible jamb to a pair of curved sides by projecting a series of spaced apart clips from the jamb into a pair of grooves formed on the sides. When assembled, the jamb is secured to an edge of the two sides such that the two sides and the jamb effectively form an arch or a section of an arch.

Other objects and advantages of the present invention will become apparent and obvious from a study of the following description and the accompanying drawings, which are merely illustrative of such invention.

DESCRIPTION OF EXEMPLARY EMBODIMENT OF THE INVENTION

With further reference to the drawings, the kit of the present invention is shown therein and indicated generally by the numeral 10. As will be appreciated from subsequent portions of this disclosure, kit 10 is designed to enable an individual to form or assemble an arch, or a section of an arch, for use in a building such as a residential structure.

Figure 1:
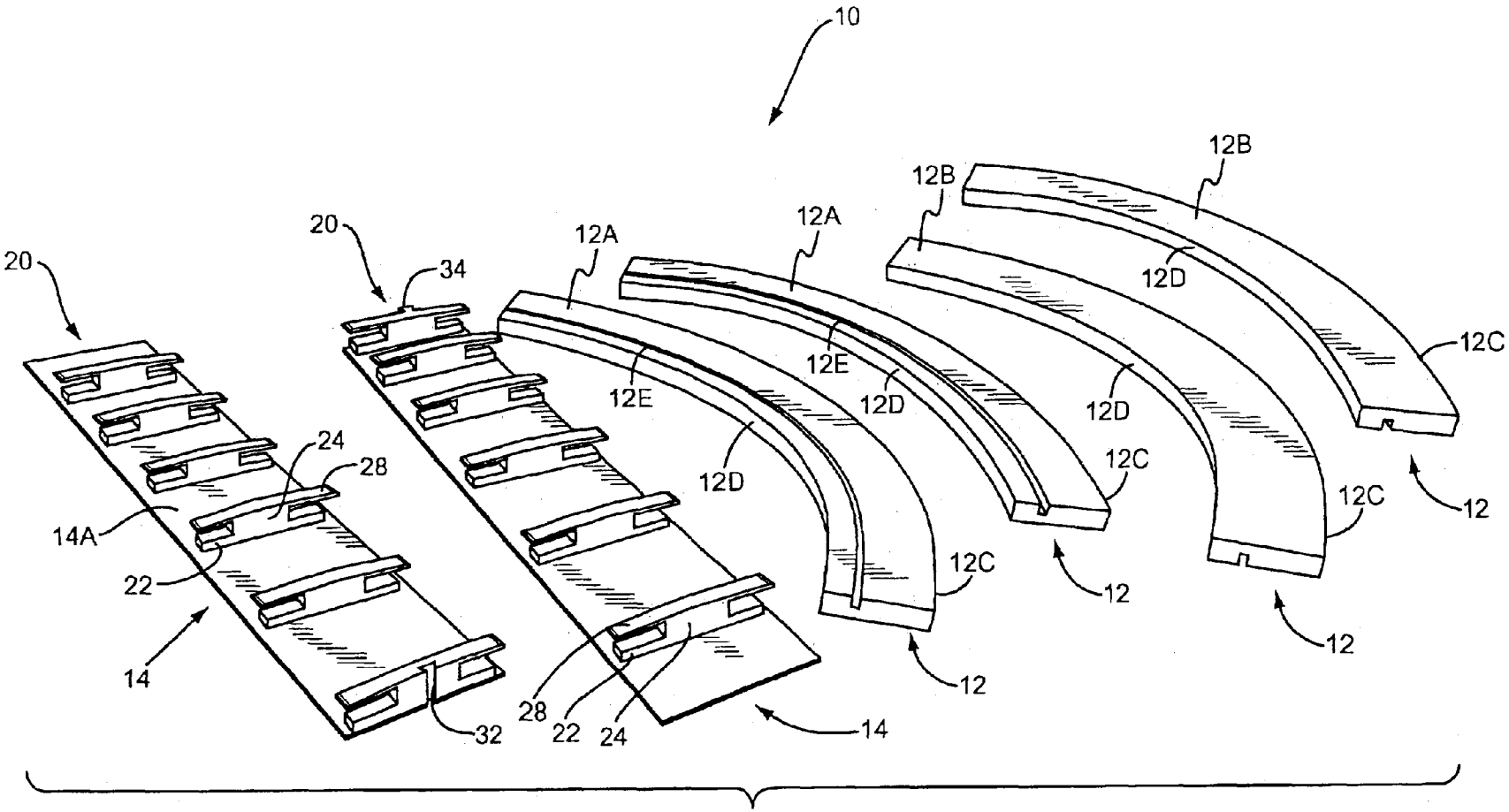
FIG. 1 illustrates the components of a typical kit for the arch section of the present invention.

With particular reference to FIG. 1, one embodiment of the kit is illustrated therein. At the outset, it should be noted that the kit illustrated in FIG. 1 is adapted to form two arch sections that are joined together. Some kits may simply include sufficient components to form one arch or one arch section. In any event, kit 10 of the present invention includes a series of sides with each side being curved and indicated generally by the numeral 12. Essentially, all of the sides 12 are very similar or identical. Thus, a discussion of one side will suffice for all of the sides shown in FIG. 1. In that regard, each side includes an inner side 12A and an outer side 12B. Further, each side includes an upper curved edge 12C and a lower curved edge 12D. Formed about the inner side 12A is a curved groove 12E. Sides 12 can be constructed of various materials such as wood or a medium density fiberboard, plastic or various other materials. In the case of the embodiment illustrated in FIG. 1, the outer side 12B is simply shown as being planar and unornamented. It will be appreciated by those skilled in the art, however, that the outer side 12B could be formed in the shape of a molding or otherwise ornamented so as to impart aesthetic appeal to the outer surface 12B of a respective side 12.

Figure 2:
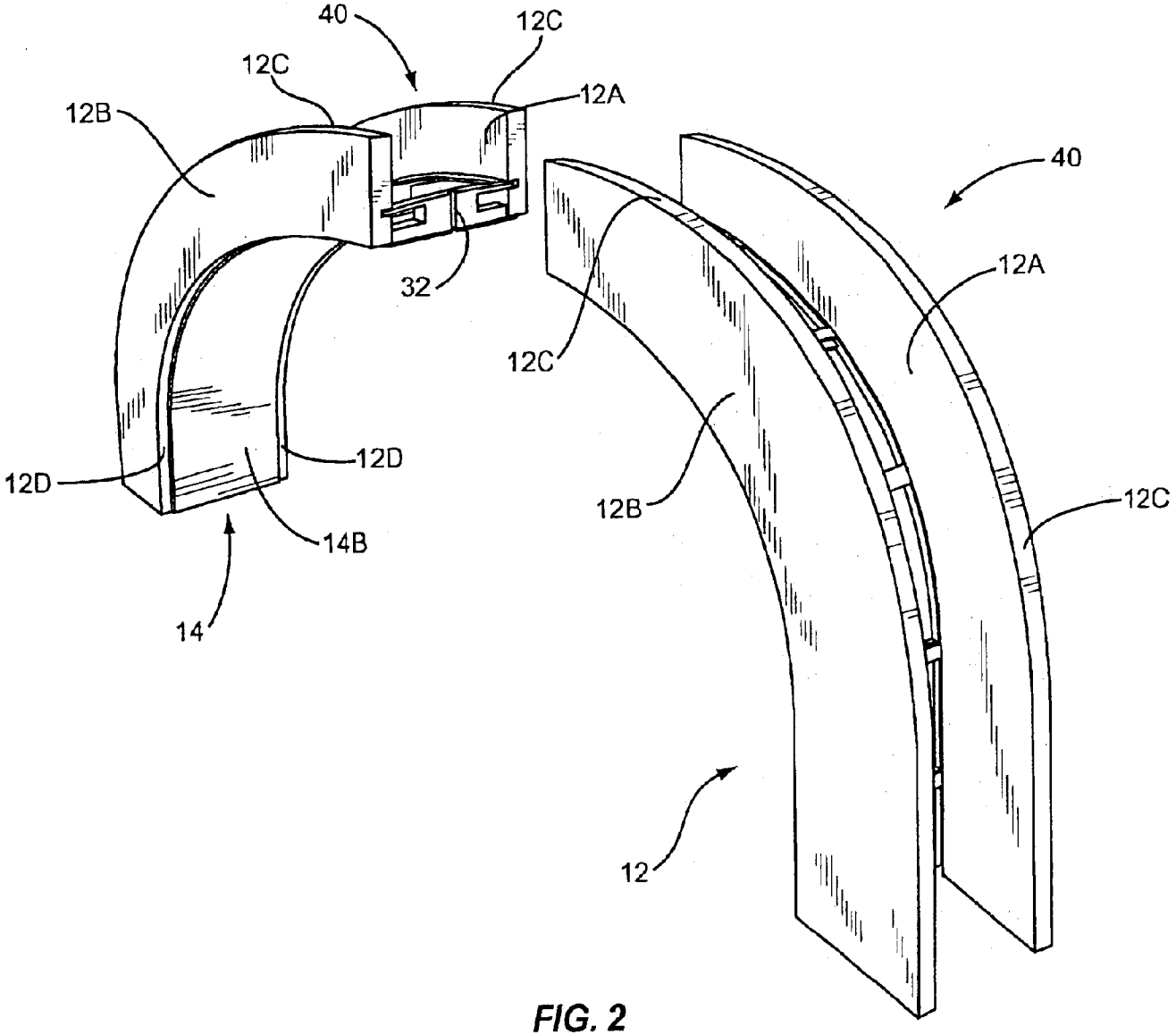
FIG. 2 is a perspective view of two arch sections, spaced from one another, assembled from the kit of the present invention.
Figure 3:
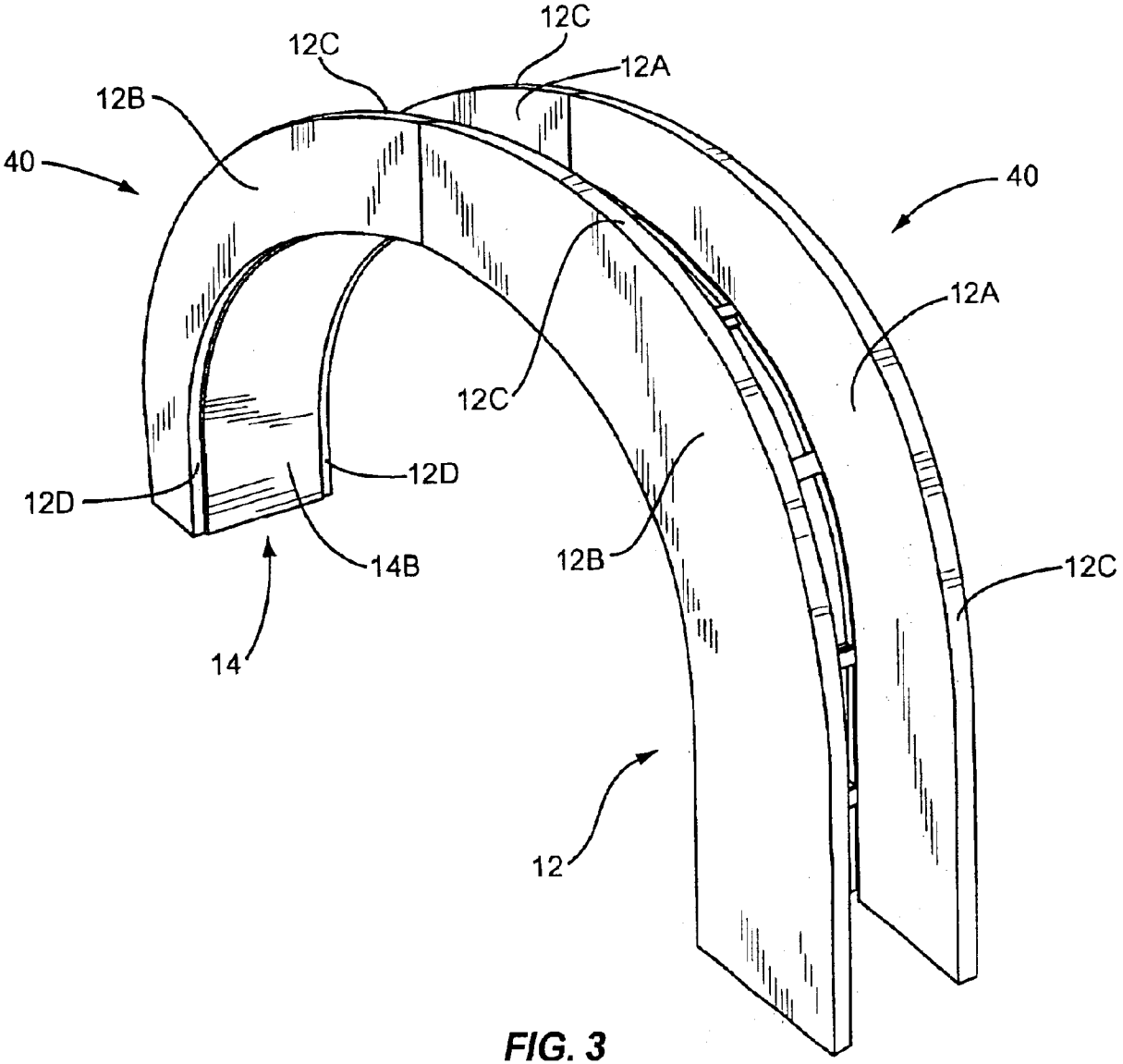
FIG. 3 is a perspective view showing the two arch sections of FIG. 2 joined together.

Kit 10 is further provided with a jamb or base indicated generally by the numeral 14. As will be appreciated from subsequent portions of this disclosure, the jamb 14 is designed to be connected between a pair of sides 12, as shown in FIGS. 2–4A. Jamb 14 includes a first side 14A and a second side 14B. The jamb can be made of various materials. Preferably jamb 14 is sufficiently flexible such that it can assume a generally straight configuration as shown in FIG. 1 and then curved to form a configuration such as shown in FIGS. 2 and 3. In one embodiment of the present invention, the jamb 14 could be made from ⅛" bendable plywood.

Secured to the first side 14A of jamb 14 is a series of spaced apart clips or fasteners indicated generally by the numeral 20. Clips 20 function to interconnect, fasten or secure the jamb 14 to a pair of sides 12. As detailed below, the clips include portions that project into the groove 12E of a pair of sides 12 and effectively pull a portion of the jamb 14 against the lower edges 12D of a pair of sides 12.

Figure 4:
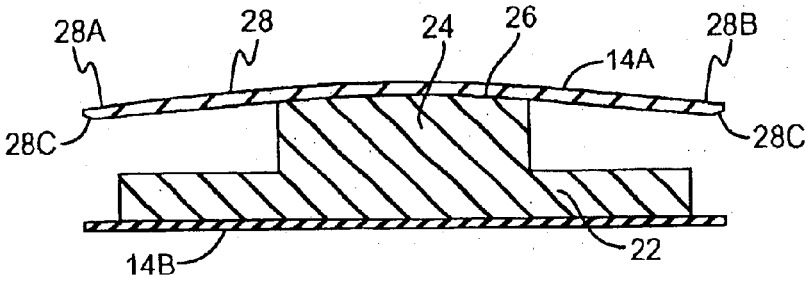
FIG. 4 is a cross-sectional view of the jamb and associated clip.

Viewing the clip 20 in more detail, it is seen from the drawings, particularly FIG. 4, that each clip includes a base that is secured to the first side 14A of the jamb. Note that the base extends transversely across the jamb 14. The base can be secured to the jamb by glue or other suitable means. The base includes a lower portion 22 that includes opposed ends that terminate just short of the adjacent edges of the jamb 14. Centrally disposed over the lower portion 22 and extending upwardly from the lower portion 22 is an upper portion 24. Note that the outer edges of the upper portion 24 terminate inwardly of the outer edges of the lower portion 22. The upper portion 24 includes a slightly curved or convex upper surface 26.

Secured to the base is a retainer 28. Retainer 28 is secured by glue or other suitable securing means to the curved upper surface 26 of the upper portion 24. Note that the span of the retainer extends beyond the outer ends of the lower portion 22. In particular, the retainer 28 includes end portions 28A and 28B. Each end portion 28A and 28B includes a beveled portion 28C. Bevel 28C facilitates the insertion or projection of the retainer 28 into the grooves 12E of the respective sides 12.

Figure 4A:
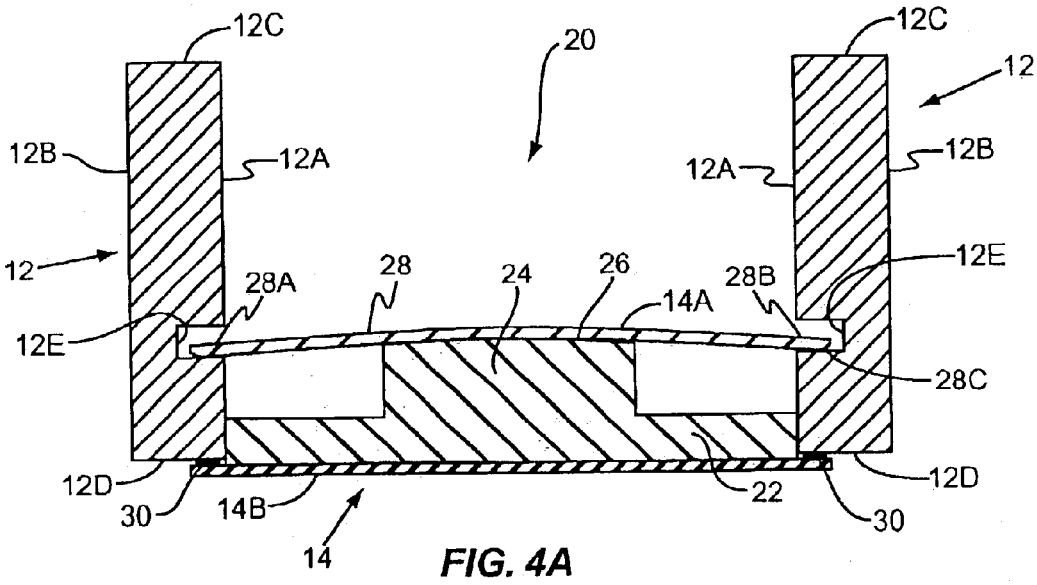
FIG. 4A is a cross-sectional view of an arch section.

With particular reference to FIG. 4A, there shown therein a cross-sectional view showing the jamb 14 secured to a pair of sides 12. Note that the retainer 28 in one embodiment, has some flexibility and acts, at least slightly, like a spring. When the opposite ends 28A and 28B of the retainer 28 are inserted into the grooves 12E, then the spring action of the retainer 28 tends to pull the jamb 14, or at least edges thereof, into engagement with the lower edge 12D of the sides 12. Note also that the opposed ends of the lower portion 22 of the base generally abut against or terminate just short of the inner side 12A of the sides 12 at a point or area just below the respective grooves 12E.

To secure the jamb to the sides 12, a line of glue is placed along each edge of the first side 14A. Thus when the jamb 14 is pulled into engagement with the lower edges 12D of the sides 12, a glue joint is formed between the jamb and the lower edges 12D of the sides 12. In FIG. 4, the glue joint is referred to by the numeral 30.

Therefore, it is appreciated that the clips 20 effectively secure the jamb 14 to two sides 12 and that together the sides 12, jamb 14 and clips 20 form an arch or an arch section.

Figure 5:
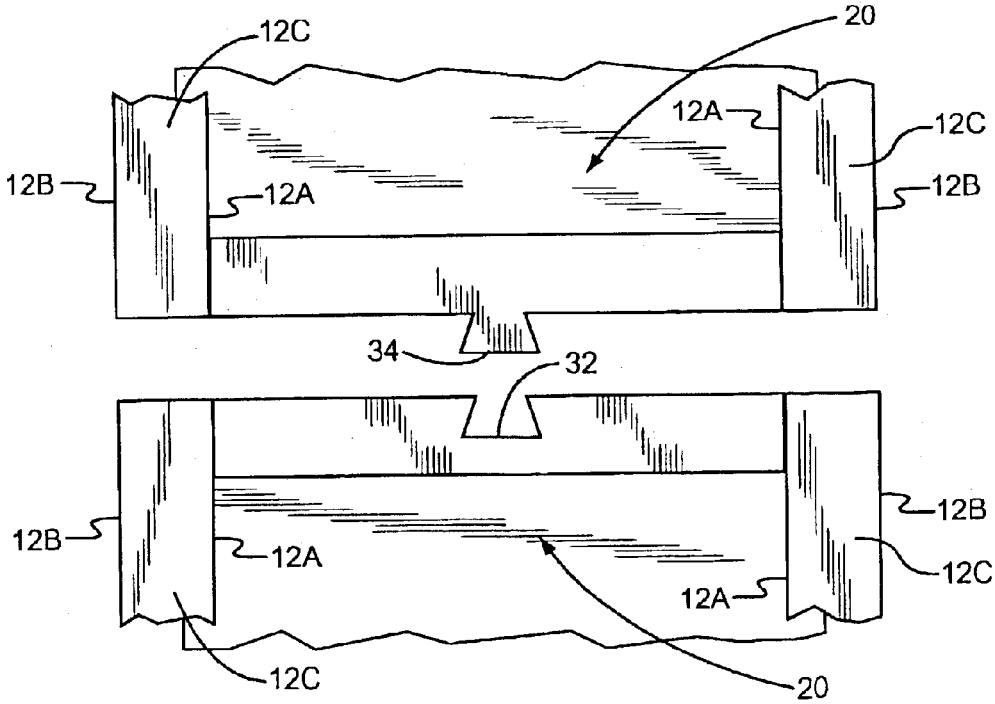
FIG. 5 is a fragmentary plan view of end portions of two arch sections.

In FIG. 2, two arch sections 40 are formed from the kit illustrated in FIG. 1. To secure the two arch sections 40 of FIG. 2 together, a dovetail joint can be provided. This dovetail joint is illustrated in FIGS. 2 and 5. Note that the two end portions of the two arch sections 40 shown in FIG. 2 are constructed such that the end of the jamb 14, the end of the sides 12 and the outer facing side of the clips 20 are all generally flush or even. In addition, one of the clips 20 would be provided with a female slot 32. Adjoining or connecting male insert 34 is provided with the other adjacent clip 20. Thus, one arch section 40 can be connected to another arch section 40 by sliding the male insert 34 into the female slot 32. To make a secure joint, glue can be provided and further the male insert 34 in the female slot 32 can be designed such that the joint created is self-locking as is common with dovetail joints.

As noted before, the kit of the present invention can be equipped with components to make one arch section or multi arch sections. Typically, these arch structures or sections are utilized in the manner described in U.S. Pat. No. 5,526,618. As can be seen in the drawings, the top portion of the arch structure arch section formed by the kit of the present invention is open. Therefore, the arch structure or arch section can be inserted upwardly around the top portion of a wall structure that is disposed adjacent an opening. The kit could be provided with a pair of capitals that would be utilized to make a transition from the lower ends of the formed arch to the jambs formed along the sides of the opening in which the arch is being fitted. Alternatively, the kit could be provided with a pair of unassembled columns of the type shown in U.S. Pat. No. 5,526,618.

The clips or fasteners 20 can assume different designs and configurations. Basically an arch or arch section will include at least one clip or fastener that extends from the jamb and connects in some way with the sides 12. In one embodiment, the arch or arch section kit is designed such that the jamb is secured into abutment with the lower edges 12D of the sides 12. In this embodiment, the clip or fastener extends from the jamb 14 between the sides 12. Again, the clip or fastener can connect or engage the sides in various ways in order to secure the jamb to the sides.

Also, it is noted that in the embodiment illustrated herein, that the jamb 14 is secured so as to leave a portion of the lower edge 12D exposed. This is particularly illustrated in FIGS. 2, 3 and 4A.

From the foregoing specification and discussion, it is seen that the arch kit of the present invention provides a series of components that can be readily assembled into an arch structure or a section of an arch structure. The components are designed so as to enable individuals that are not highly skilled craftsmen to readily assemble an arch structure and install it in a building without professional assistance. Further, the design of the present kit enables the arch to be packaged in a very compact and efficient manner, such as flat packing, that makes mass merchandising practical and also provides for the possibility of utilizing arch structures in low to medium range priced homes.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A kit for forming an arch or a section of an arch for use in buildings such as residential structures, comprising:

a. a pair of curved sides;

b. a curved groove formed in each side;

c. a jamb adapted to assume a curved configuration; and d. a series of clips secured to the jamb and adapted to extend into the grooves of the sides for securing the jamb to the side.

2. The kit of claim 1 wherein the jamb is flexible and can assume a generally straight configuration or a generally curved configuration.

3. The kit of claim 1 wherein the jamb includes first and second sides and wherein the clips are secured to one side of the jamb in spaced apart relationship.

4. The kit of claim 1 wherein each clip includes a base secured to the jamb and a retainer extending from the base for projecting into the pair of grooves.

5. The kit of claim 4 wherein the retainer is at least slightly flexible and wherein the series of retainers forming a part of the clips act to pull the jamb against the sides.

6. The kit of claim 5 wherein the base of each clip includes an upper surface that supports the retainer and wherein the upper surface is slightly curved.

7. The kit of claim 1 wherein each side includes a curved edge, and wherein when the clips are engaged within the grooves, the jamb is pulled against the edges of the sides.

8. The kit of claim 1 wherein the kit includes components to make two or more arched sections, and wherein the two or more arched sections are adapted to be joined.

9. The kit of claim 8 wherein each arched section is provided with a clip disposed adjacent one end of the arched section that is adapted to be joined with a like clip disposed on the end of another arched section.

10. The kit of claim 9 wherein the clips disposed on one end of each of the arched sections includes a portion of a dovetail joint that permits the two clips disposed on the ends of the arched sections to be joined through a dovetailed joint.

11. The kit of claim 1 wherein the jamb includes a bendable plywood member.

12. The kit of claim 1 wherein when assembled forms an arched section that includes the two sides disposed in spaced apart relationship and the jamb extending in a curved fashion adjacent an edge of each side: and wherein the clips are disposed in spaced apart relationship on the jamb and extend therefrom between the sides and wherein a portion of the respective clips project into the grooves formed in the sides.

13. A kit for forming an arch or arch section for use in a building such as a residential structure, the kit comprising:

a. a pair of curved sides with each side including an inner face, an outer face, a lower edge and an upper edge;

b. a curved groove formed in the inner face of each side;

c. a jamb adapted to assume a curved configuration and including first and second faces;

d. at least two fasteners secured in spaced apart relationship to the first face of the jamb, each fastener extending from the first face and adapted to extend between the sides of the arch or arch section when the kit is assembled; and e. wherein each fastener includes a retainer that when the arch or arch section is assembled extends between the sides and projects into the pair of grooves formed on the inner faces of the sides so as to retain the jamb adjacent the sides.

14. The kit of claim 13 wherein the sides and jamb with the fastener secured thereto are packaged individually and unassembled.

15. The kit of claim 13 wherein each fastener includes a base that extends across the first side of the jamb, and wherein the retainer extends from the base.

16. The kit of claim 15 wherein the base includes a lower portion that stretches substantially across the first side of the jamb and an upper portion that extends from the lower portion with the upper portion being narrower than the lower portion; and wherein the retainer is secured to the upper portion.

17. The kit of claim 16 wherein the upper portion of the base includes a curved upper surface and wherein the retainer conforms to the curved upper surface of the upper portion.

18. The kit of claim 17 wherein the retainer comprises an elongated relatively thin member that is at least slightly flexible.

19. The kit of claim 18 wherein the retainer includes opposed ends and wherein the opposed ends of the retainer include a beveled surface for facilitating the insertion of the opposed ends of the retainer into the grooves formed in the sides.

20. The kit of claim 13 wherein the retainer of each fastener includes opposed ends that are adapted to project into the grooves of the pair of sides and wherein each end of the retainer includes a beveled surface.

21. A kit for forming an arch or an arch section comprising:

a. a pair of curved sides with each side including an upper edge and a lower edge;

b. a pliable jamb having first and second sides and adapted to assume a curved configuration; and c. at least one fastener secured to a face of the jamb and adapted to extend between the pair of curved sides for securing the jamb to the lower edges of the sides such that the jamb abuts against and curves along the lower edges.

22. The kit of claim 21 wherein each side includes an inner face and wherein the fastener is secured to one side of the jamb and extends therefrom to where the fastener connects to the inner faces of the sides.

23. The kit of claim 21 wherein the inner faces of the sides include a curved groove and wherein the fastener projects into the curved groove.

24. The kit of claim 21, wherein when the arch or arch section is formed glue is placed between the jamb and the lower edges of the sides.

25. The kit of claim 21 wherein the fastener is secured to the jamb and projects therefrom upwardly between the sides.

26. The kit of claim 21 wherein each side includes an outer face and wherein the jamb includes outer edges, and wherein when the jamb is secured to the lower edges of the sides, the outer edges of the jamb terminate short of the outer faces of the sides and thereby leave a portion of the lower edges of the sides exposed.

27. The kit of claim 21 wherein a pliable jamb is adapted to assume a generally straight configuration but is sufficiently pliable to permit the jamb to be manually formed into a curved configuration.

28. The kit of claim 21 including a series of spaced apart fasteners secured to the jamb wherein the fasteners secure the jamb against the lower edges of the sides.

29. The kit of claim 21 wherein the kit includes the fastener and jamb already secured together.

* * * * *